US005624279A

United States Patent [19]

Clark et al.

[11] Patent Number: 5,624,279

[45] Date of Patent: Apr. 29, 1997

[54] ELECTRICAL HEADER ASSEMBLY HAVING BRIDGED CODING BAR

[75] Inventors: Stephen L. Clark, Dillsburg; William K. Nailor, III, Camp Hill, both of Pa.

[73] Assignee: Berg Technology, Inc., Reno, Nev.

[21] Appl. No.: 367,797

[22] Filed: Dec. 30, 1994

[51] Int. Cl.[6] ..... H01R 13/64

[52] U.S. Cl. ..... 439/680; 439/79

[58] Field of Search ..... 439/680, 681, 439/677, 55, 59, 62, 78, 79, 80

[56] References Cited

U.S. PATENT DOCUMENTS

| | | | |
|---|---|---|---|
| 3,112,974 | 12/1963 | Curtis et al. | 439/680 |
| 3,184,707 | 5/1965 | Anderson | 439/681 |
| 3,200,361 | 8/1965 | Schwartz et al. | 439/76.1 |
| 4,533,203 | 8/1985 | Feldman et al. | 439/681 |
| 4,721,473 | 1/1988 | DelGuidice et al. | 439/79 |
| 4,859,191 | 8/1989 | Tonooka et al. | 439/680 |
| 5,044,994 | 9/1991 | Van Woensel | 439/681 |
| 5,249,974 | 10/1993 | Wang | 439/79 |

*Primary Examiner*—Hien Vu

*Attorney, Agent, or Firm*—Daniel J. Long; M. Richard Page

[57] ABSTRACT

Disclosed is an electrical header assembly comprised of an insulative housing having pins extending from its mounting and mating sides and a mounting bracket adjacent its mounting side. A coding bar is superimposed over its mating side and is retained in position by a horizontal support having a vertical footer positioned between the bracket and its mounting side.

6 Claims, 2 Drawing Sheets

ELECTRICAL HEADER ASSEMBLY HAVING BRIDGED CODING BAR

BACKGROUND OF INVENTION

1. Field of the Invention

The present invention relates to electrical connectors and more particularly to electrical header assemblies.

2. Brief Description of the Prior Developments

Connector assemblies have been provided with various key or coding arrangements which are intended to insure that only pre-selected parts can be plugged into each other.

For example, U.S. Pat. No. 3,184,707 discloses a receptacle shell in which a coding plate having a number of apertures is positioned over the shell aperture. Pins on the mating shell are positioned to enter the apertures in the coding plates while shells with the pins positioned in other positions will not.

U.S. Pat. No. 3,200,361 discloses a coding arrangement for printed circuit board connector assembly. A peripheral wall surrounds the printed circuit board and one section of this wall has a plurality of apertures that are arranged in a pre-determined pattern to effect the coded arrangement. The connector capable of being engaged with this circuit board has a plurality of projections aligned with the apertures in the connector when the connector and the circuit board are engaged.

Various other coding devices have been suggested for other purposes, for example as is disclosed in U.S. Pat. No. 5,044,994. A need, however, still remains for a coding device which can easily and inexpensively be attached to a header assembly.

SUMMARY OF THE INVENTION

In the electrical header assembly of the present invention an insulative housing which has pins extending from its opposed sides is fixed to a surface by means of a bracket attached to its mounting side. A coding bar is positioned above its mating side and this coding bar is attached to the header and the bracket by means of a horizontal bridging support which is connected to a vertical foot. This vertical foot is positioned between the mounting side of the header and the mating side of the bracket. There are a plurality of notches in the coding bar which correspond to projections in a cable connector so that only an intended cable connector can mate with this header.

BRIEF DESCRIPTION OF THE DRAWINGS

The header assembly of the present invention is further explained with reference to the accompanying drawings in which.

DETAILED DESCRIPTION OF THE PREFERRED EMBODIMENT

Figure 1:
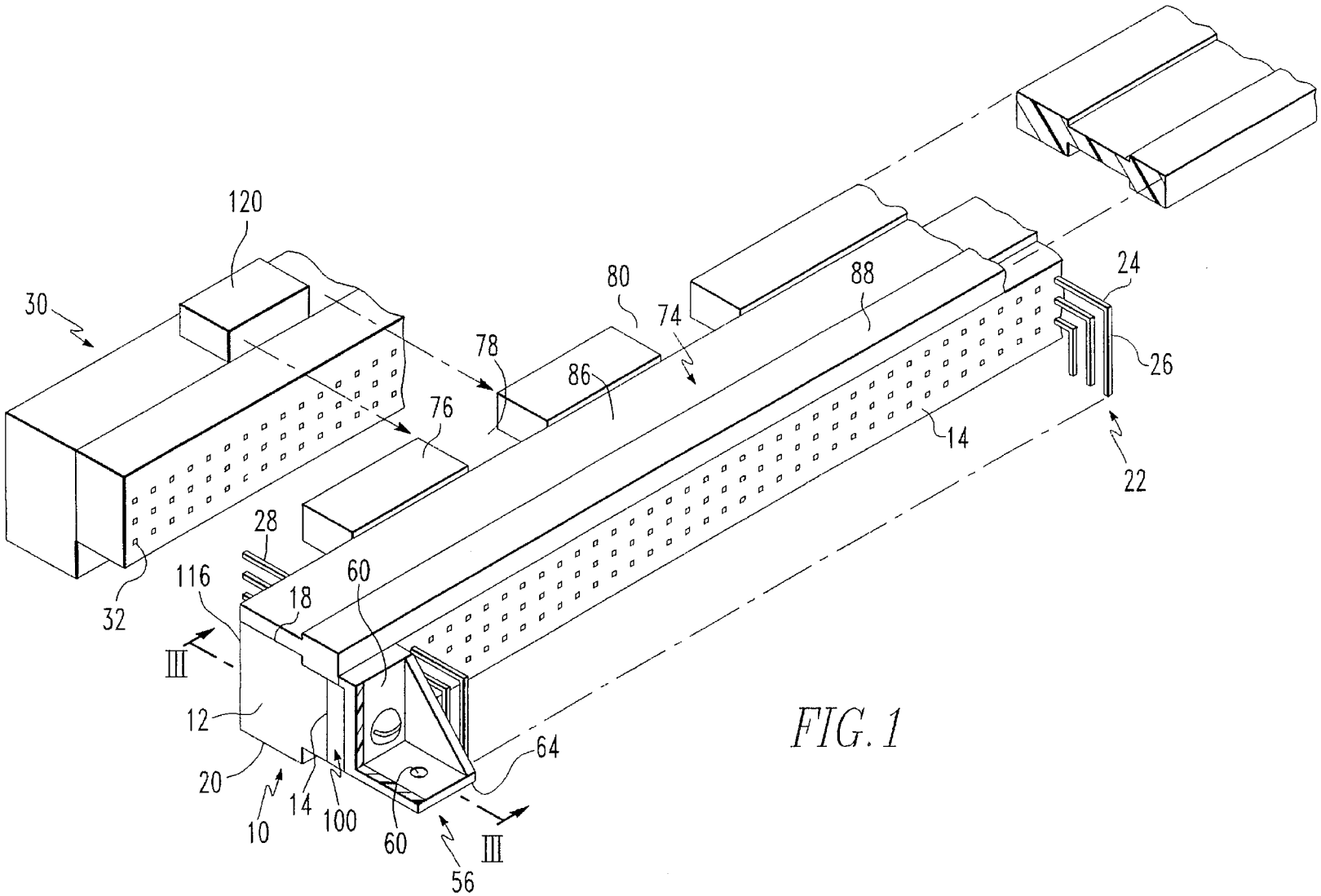
FIG. 1 is a fragmented prospective view of the header assembly of the present invention and the mating cable assembly.
Figure 2:
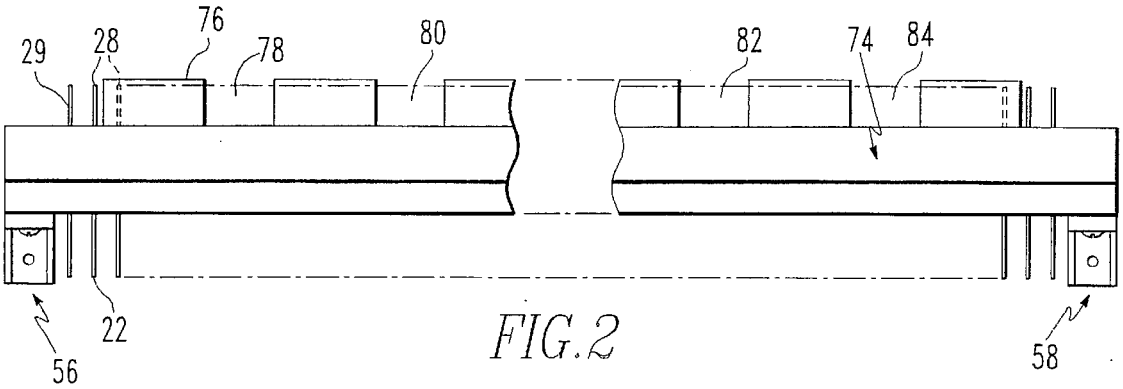
FIG. 2 is a fragmented plan view of the header assembly of the present invention.
Figure 3:
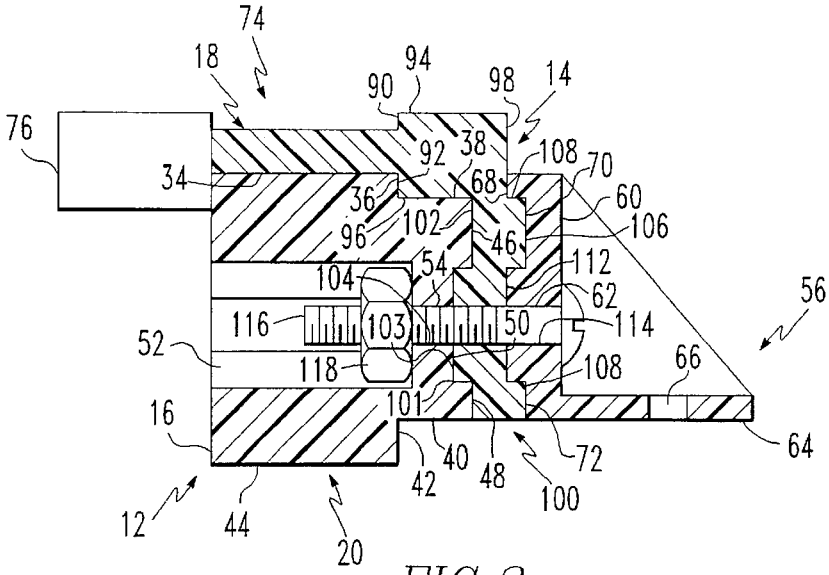
FIG. 3 is a cross sectional view of the header assembly of the present invention through line III—III in FIG. 1.

Referring to the drawings, the header assembly of the present invention is shown generally at numeral 10. This header assembly consists of insulated housing 12 which has a mounting side 14, a mating side 16, a top side 18 and a bottom side 20. Right angle pins as 22 extend from the mounting side. These pins have a horizontal section 24 and extend downwardly in a vertical section 26. Horizontal pins as at 28 extend from the mating side of the housing. These rearwardly extending pins connect with a cable connector 30 through contact apertures as at 32. The top side of the insulative housing has an upper ledge 34, a vertical section 36 and a lower ledge 38. The bottom side of the housing has a lower ledge 40, a vertical section 42 and an upper ledge 44. The front wall of the housing has an upper projection 46, a lower projection 48 and a medial recess 50. Extending through the insulative housing there are major horizontal bores as 52 which are longitudinally aligned with minor horizontal bores as at 54. These bores are positioned adjacent brackets shown generally at numerals 56 and 58. Each of these brackets has a vertical section as at 60 with a connection aperture as at 62 and a horizontal aperture 64 with a connection aperture as at 66. The vertical sections have an inner side as at 68 with recesses as at 70 and 72. A coding member is shown generally at numeral 74. This coding member includes a rear coding bar 76 which has a number of notches as at 78, 80, 82 and 84. This coding bar is retained in its position above the rear side of the housing by means of a horizontal support 86 which has on its opposite side above the front side of the housing a vertical stop 88. This vertical stop has an upward vertical wall 90 and a downward vertical wall 92. Extending from the upward vertical surface there is a top horizontal surface 94 and extending from the downward vertical wall there is a bottom horizontal surface 96. The stop also includes a vertical front surface 98. Extending downwardly from the bottom horizontal surface there is a vertical footer shown generally at numeral 100. On its inner surface 101 it has a top recess 102 and bottom recess 103. It also has a medial inward projection which mates with the medial recess in the housing. Aligned with the horizontal bores in the housing and the aperture in the bracket there is a footer aperture 114 which receives a screw 116 that is engaged by nut 118 which connects the bracket, the coding member and the housing together. A projection 120 extends upwardly from the cable connector. This projection is appropriately positioned in a manner well known in the art, so that it will engage notch 78 in the coding bar 76. Projections not positioned to engage notch 78 or one of the other notches would prevent cable connectors on which they are located from mating with this particular header assembly. It will also be possible to engage one or more smaller connectors to the header so that these connectors are positioned at particular advantageous positions.

It will be appreciated that it has been disclosed a means of efficiently and inexpensively connecting a coding bar to a header assembly.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector header assembly comprising:

(a) an insulative housing having a mating side, a mounting side, a top side and a bottom side and having a first plurality of pins extending from the mounting side and a second plurality of pins extending from the mating side wherein said mounting and mating sides are in opposed relation;

(b) at least one attachment bracket having a first section and a second section wherein said first section is positioned in spaced adjacent relation to the mounting side of said insulative housing; and (c) an insulative coding member having a coding bar thereon, and said insulative coding member being positioned on one of said top or bottom sides adjacent one of said mating or mounting sides of the insulative housing and having a depending footer engaging a rear portion of the insulative coding member and positioned between said attachment bracket and said insulative housing, wherein said footer is fixed to the first section of the attachment bracket and the mounting side of the housing such that the insulative coding member and its depending footer serves to structurally support the entire assembly as well as perform a coding function.

2. The electrical connector header of claim 1 wherein the first section of the bracket is a vertical section and the second section of the bracket is a horizontal section.

3. The electrical header assembly of claim 1 wherein the insulative coding member is superimposed over the mating side of the insulative housing.

4. The electrical header assembly of claim 3 wherein the footer is connected to the insulative coding member by a horizontal support.

5. The electrical header assembly of claim 1 wherein the coding code bar has at least one notch which is aligned with a vertical projection on a mating cable connector.

6. The electrical header assembly of claim 5 wherein there are a plurality of spaced notches on the coding bar.

* * * * *